US010324419B2

(12) United States Patent
Damasko

(10) Patent No.: US 10,324,419 B2
(45) Date of Patent: Jun. 18, 2019

(54) MECHANICAL OSCILLATING SYSTEM FOR A CLOCK AND FUNCTIONAL ELEMENT FOR A CLOCK

(71) Applicant: Damasko GmbH, Barbing (DE)

(72) Inventor: Konrad Damasko, Regensburg (DE)

(73) Assignee: Domasko GmbH, Barbing (DE)

( * ) Notice: Subject to any disclaimer, the term of this patent is extended or adjusted under 35 U.S.C. 154(b) by 128 days.

(21) Appl. No.: 14/825,484

(22) Filed: Aug. 13, 2015

(65) Prior Publication Data

US 2015/0346687 A1 Dec. 3, 2015

Related U.S. Application Data

(63) Continuation-in-part of application No. 13/148,160, filed as application No. PCT/DE2010/000126 on Feb. 4, 2010, now abandoned.

(30) Foreign Application Priority Data

Feb. 6, 2009 (DE) ..... 10 2009 007 973
Mar. 20, 2009 (DE) ..... 10 2009 013 741
(Continued)

(51) Int. Cl.
*G04B 17/22* (2006.01)
*G04B 17/34* (2006.01)

(52) U.S. Cl.
CPC ..... *G04B 17/345* (2013.01); *G04B 17/227* (2013.01)

(58) Field of Classification Search
CPC .... G04B 17/06; G04B 17/066; G04B 17/345; G04B 17/227
See application file for complete search history.

(56) References Cited

U.S. PATENT DOCUMENTS 2,682,744 A 7/1954 Chilowsky
6,621,137 B1 * 9/2003 Ma ..... B81C 1/00333 257/528
(Continued)

FOREIGN PATENT DOCUMENTS

DE 69608724 T2 2/2001
DE 10127733 A1 2/2003
(Continued)

OTHER PUBLICATIONS

Polycrystalline silicon—wikipedia.org; 2007.*
(Continued)

*Primary Examiner* — Sean P Kayes
(74) *Attorney, Agent, or Firm* — Simpson & Simpson, PLLC

(57) ABSTRACT

A mechanical oscillating system for a clock including a balance spring manufactured from a non-metallic, polycrystalline material with a grain size between 10 and 50,000 nm, with a winding area of the balance spring 0.001 $mm^2$ to 0.3 $mm^2$, an oscillating body and a shaft for mounting of the oscillating body and the balance spring on the shaft. A spiral spring for a clock being manufactured from a non-metallic material, wherein the non-metallic material is a polycrystalline material with a grain size between 10 and 50,000 nm, and having a linear thermal expansion coefficient smaller than $8\times10^{-6}$/K.

14 Claims, 6 Drawing Sheets

(30) Foreign Application Priority Data

| | | |
|---|---|---|
| Jun. 17, 2009 | (DE) | 10 2009 025 645 |
| Jun. 24, 2009 | (DE) | 10 2009 030 539 |
| Jul. 3, 2009 | (DE) | 10 2009 031 841 |
| Sep. 24, 2009 | (DE) | 10 2009 050 045 |
| Oct. 7, 2009 | (DE) | 10 2009 048 580 |
| Dec. 21, 2009 | (DE) | 10 2009 060 024 |
| Jan. 4, 2010 | (DE) | 10 2010 004 025 |
| Jan. 20, 2010 | (DE) | 10 2010 005 257 |
| Feb. 4, 2010 | (DE) | 10 2010 006 790 |

(56) References Cited

U.S. PATENT DOCUMENTS

| | | | | |
|---|---|---|---|---|
| 6,755,566 | B2 * | 6/2004 | Damasko | G04B 15/14 368/127 |
| 7,077,562 | B2 | 7/2006 | Bourgeois et al. | |
| 7,641,381 | B2 | 1/2010 | Levingston | |
| 8,167,481 | B2 * | 5/2012 | Takeuchi | C10M 125/02 368/220 |
| 9,836,024 | B2 * | 12/2017 | Di Domenico | G04B 17/045 |
| 2006/0055097 | A1 * | 3/2006 | Conus | G04B 17/066 267/273 |
| 2006/0225526 | A1 | 10/2006 | Levingston | |
| 2007/0133355 | A1 * | 6/2007 | Hara | C22C 14/00 368/140 |
| 2007/0290320 | A1 * | 12/2007 | Onodera | H01L 25/105 257/686 |
| 2008/0008050 | A1 | 1/2008 | Bourgeois | |
| 2008/0101163 | A1 | 5/2008 | Bravo et al. | |
| 2009/0116343 | A1 * | 5/2009 | Levingston | F16F 1/10 368/140 |
| 2009/0226718 | A1 * | 9/2009 | Hasegawa | C03C 17/007 428/338 |
| 2010/0054090 | A1 * | 3/2010 | Orny | G04B 17/063 368/175 |
| 2010/0214880 | A1 * | 8/2010 | Rappo | B81C 1/00682 368/127 |
| 2010/0290320 | A1 * | 11/2010 | Gygax | G04B 1/145 368/177 |
| 2015/0277382 | A1 | 10/2015 | Conus et al. | |

FOREIGN PATENT DOCUMENTS

| | | | |
|---|---|---|---|
| EP | 0732635 | A1 | 9/1996 |
| EP | 1422436 | | 5/2004 |
| EP | 1445670 | A1 | 8/2004 |
| EP | 1837722 | A2 | 9/2007 |
| FR | 2842313 | A1 | 1/2004 |
| WO | 2005045532 | A2 | 5/2005 |
| WO | 2006123095 | A2 | 11/2006 |
| WO | WO2007000271 | | 1/2007 |

OTHER PUBLICATIONS

Thermal expansion—Wikipedia—wikipedia.org—2013.*

Silicium, Silicium (Si)—Periodensystem der Elemente (PSE), Perioden System Info, http://www.periodensystem.info/elemente/silicium.

Workshop, PV-UNI-NETZ ForschungsVerbund Sonnenenergie, Photovoltaik:Materialforschung in Deutschland, 11.-Dec. 12, 2003 in Berlin, ForschungsVerbund FVS Sonnenenergie, P Uni-Netz.

Translation of International Search Report (Application No. PCT/DE2010/000126) dated Sep. 23, 2010.

Translation of International Preliminary Report on Patentability (Application No. PCT/DE2010/000126) dated 9, 2011.

Rech, Bernd and Markus Schubert. "Dünnschichttechnologie mit Silizium: Von amorph bis einkristallin", Universitat Stuttgart, ipe.uni-stuttgart.de, Workshop 2003 (See English language relevance in Statement attached).

* cited by examiner

MECHANICAL OSCILLATING SYSTEM FOR A CLOCK AND FUNCTIONAL ELEMENT FOR A CLOCK

CROSS REFERENCE TO RELATED APPLICATIONS

This patent application is a Continuation-in-Part of U.S. patent application Ser. No. 13/148,160, filed Aug. 5, 2011, which is a 371 national stage entry of International Patent Application No. PCT/DE2010/000126, filed on Feb. 4, 2010, and claims priority from German Patent Application No. 10 2010 006 790.3, filed Feb. 4, 2010; German Patent Application No. 10 2010 005 257.4, filed Jan. 20, 2010; German Patent Application No. 10 2010 004 025.8, filed Jan. 4, 2010; German Patent Application No. 10 2009 060 024.8, filed Dec. 21, 2009; German Patent Application No. 10 2009 048 580.5, filed Oct. 7, 2009; German Patent Application No. 10 2009 050 045.6, filed Sep. 24, 2009; German Patent Application No. 10 2009 031 841.0, filed Jul. 3, 2009; German Patent Application No. 10 2009 030 539.4, filed Jun. 24, 2009; German Patent Application No. 10 2009 025 645.8, filed Jun. 17, 2009; German Patent Application No. 10 2009 013 741.6, filed Mar. 20, 2009; and, German Patent Application No. 10 2009 007 973.4, filed Feb. 6, 2009, all of which are hereby incorporated by reference in their entireties.

FIELD OF THE INVENTION

The present invention broadly relates to mechanical oscillating systems for clocks and functional elements for clocks, especially in the form of spiral springs or oscillating bodies or spring retainer blocks.

BACKGROUND OF THE INVENTION

Springs or balance springs (spiral spring) of a mechanical oscillating system can be manufactured from silicon and its surfaces can be provided with a layer of silicon oxide for improving the mechanical stability and for temperature compensation. Especially when the silicon oxide layer has been applied thermally, in the case of layer thicknesses which would be required for optimal temperature compensation, i.e., in case of thicknesses greater than 4 μm, there is a danger of deformation, at least partial deformation of the balance spring, which then leads to adverse effects on the accuracy of the oscillating system and/or non-reproducible conditions in production.

SUMMARY OF THE INVENTION

The invention broadly comprises a mechanical oscillating system for a clock including a balance spring manufactured from a non-metallic, polycrystalline material having a grain size between 10 and 50,000 nm, and having a winding area of the balance spring 0.001 $mm^2$ to 0.3 $mm^2$, an oscillating body and a shaft for mounting of the oscillating body and the balance spring on the shaft.

The invention broadly comprises a spiral spring for a clock being manufactured from a non-metallic material, wherein the non-metallic material is a polycrystalline material with a grain size between 10 and 50,000 nm, and having a linear thermal expansion coefficient smaller than $8\times10^{-6}$/K.

Functional elements according to the invention include, in particular, such elements of a mechanical oscillating system for clocks and especially for mechanical clocks or wristwatches, namely, in particular, the spiral spring or balance spring, the oscillating body or the balance wheel, the shaft of the oscillating body, elements for fastening the balance spring on the oscillating body or elements for fastening the balance spring on the shaft of the oscillating body and on a bottom plate of the clockwork, the so-called double plate on the shaft of the oscillating body for deflection of the pallet. Functional elements according to the invention also include gear wheels of a clockwork in general.

The object of the invention is to provide an oscillating system that avoids these disadvantages.

The invention is based inter alia on the knowledge that high accuracy, in particular also temperature-independent accuracy, can be achieved especially easily in a mechanical oscillating system with a balance spring made of a non-metallic crystalline or sintered material with a grain size between 10 and 50,000 nm and with a linear thermal expansion coefficient smaller than $8\times10^{-6}$/K and/or of silicon through the use of molybdenum (Mo) for the oscillating body or the balance spring, namely, in particular, also in the case of a considerably reduced thickness of a silicon oxide coating of the balance spring.

According to one aspect of the invention, in the case of the mechanical oscillating system for clocks, especially for wristwatches, with a balance spring and an oscillating body, the balance spring is made of silicon and the oscillating body, for temperature compensation, is made of molybdenum or an alloy with a high molybdenum content, in which this oscillating system in a further embodiment of the invention is designed so that the surface of the balance spring is provided with a layer of silicon oxide, and/or the silicon oxide layer has a maximum thickness of 4 μm, preferably a maximum thickness of 3 μm, and/or the oscillating body is a wheel-shaped or disk-shaped oscillating body, and/or the balance spring is made of polycrystalline silicon or a silicon ceramic, e.g., of silicon nitride, and/or adjusting elements are provided on a radially outer area of the oscillating body or of a balance wheel forming this oscillating body for adjusting the dynamic moment of inertia of the oscillating body relative to its axis of oscillation, and/or the centering elements respectively comprise at least one center of mass which is rotatably or pivotably offset on the mass body in relation to the rotary or pivot axis around an axis parallel or essentially parallel to the axis of oscillation, and/or the adjusting elements are held by clipping or locking on the oscillating body or on the inner side of the balance wheel or a ring of the balance wheel, and/or a spring retainer block with a clamping gap is provided for holding by clamping of the spiral or balance spring in the area of its outer spring end, and that the above features of the oscillating system can be used individually or in any combination.

In further embodiments of the invention, the oscillating body or the balance wheel is designed, for example, so that the adjusting elements are held by clipping or locking on the oscillating body or on the inner side of the balance wheel or a ring of the balance wheel, and/or the oscillating body is manufactured from molybdenum or an alloy with a high molybdenum content, and that the above features can be used individually or in any combination.

According to a further aspect of the invention, in the case of a spiral spring for a mechanical oscillating system for clocks, the spiral spring body is provided in the area of its outer end with a multiply wave-shaped section, in which the spiral spring in a further embodiment of the invention is designed so that it is made of silicon, and/or it is made of polycrystalline silicon or a silicon ceramic, e.g., of silicon nitride, and that the above features of the spiral spring can be used individually or in any combination.

According to a further aspect of the invention the oscillating body or balance wheel for a mechanical oscillating system for clocks, especially for wristwatches, comprises adjusting elements attached to a radially outer area of the oscillating body for adjusting the dynamic moment of inertia of the oscillating body in relation to its oscillating axis, in a further embodiment of the invention so that the centering elements respectively comprise at least one center of mass which is rotatably or pivotably offset on the mass body in relation to the rotary or pivot axis around an axis parallel or essentially parallel to the axis of oscillation, and/or that it has a spoked wheel-shaped design, and/or the adjusting elements are held by clipping or locking on the oscillating body or on the inner side of the balance wheel or a ring of the balance wheel, and/or it is manufactured from molybdenum or an alloy with a high molybdenum content, and that the above characteristics of the oscillating body can be used individually or in any combination.

According to a further aspect of the invention, a functional element for clocks, especially mechanical clocks or wristwatches, in a further embodiment of the invention is designed, for example, so that it is manufactured from a non-metal material, which is a crystalline or sintered material with a grain size between 10 and 50,000 nm and/or with a linear thermal expansion coefficient smaller than $8\times10^{-6}$/K and/or a silicon-based sintered material or a silicon sintered material, and/or in the case of elongated grain formation, the grain width is between 10 and 100 nm and the grain length is between 2 and 50 μm, preferably between 5 and 50 μm, and/or the non-metal material is a silicon-base material or a silicon-sintered material, and/or in the case of being designed as a spiral spring, the winding area is 0.001 $mm^2$ to 0.01 $mm^2$ or 0.001 $mm^2$ to 0.03 $mm^2$ or 0.001 mm2 to 0.3 $mm^2$, and/or it forms at least one bearing and/or sliding and/or mounting surface on which the surface of the function element consists of an inner layer of silicon oxide and a DLC coating forming the outer surface, and/or at least one metal intermediate layer is provided between the outer layer formed by the DLC coating and the inner layer of silicon oxide, and/or the intermediate layer is designed as a single or multiple layer, and/or the intermediate layer or the at least one layer of this intermediate layer consists of titanium nitride and/or titanium carbide and/or tungsten carbide, and/or it is designed as a spiral or balance spring, as an oscillating body, as a staff, especially a balance staff, as an escapement, as an escape wheel, as a watch plate on the balance staff or as a dented wheel, and that the above features of the functional element can be used individually or in any combination.

Further embodiments, advantages and applications of the invention are also disclosed in the following description of exemplary embodiments and the drawings. All characteristics described and/or pictorially represented, alone or in any combination, are subject matter of the invention, regardless of their combination in the claims or the dependencies of the claims. The content of the claims is also an integral part of the description.

BRIEF DESCRIPTION OF THE DRAWINGS

The invention is described in more detail below with reference to the following figures and based on exemplary embodiments in which.

DETAILED DESCRIPTION OF THE INVENTION

Figure 2:
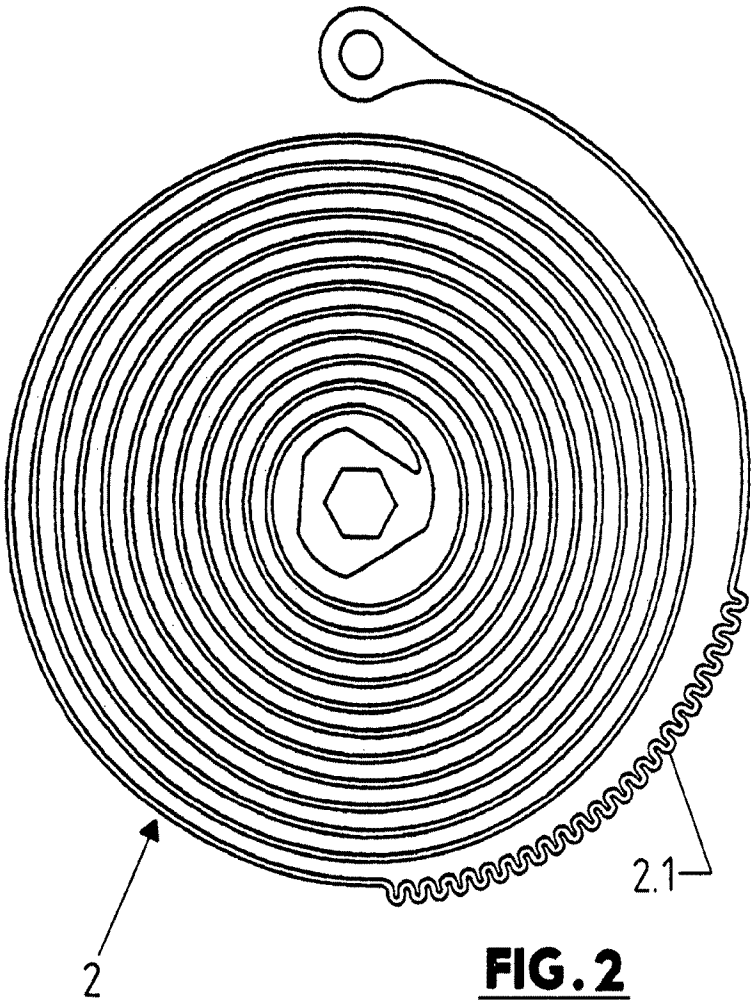
FIG. 2 is a top view showing the spiral spring of the oscillating system of FIG. 1.
Figure 1:
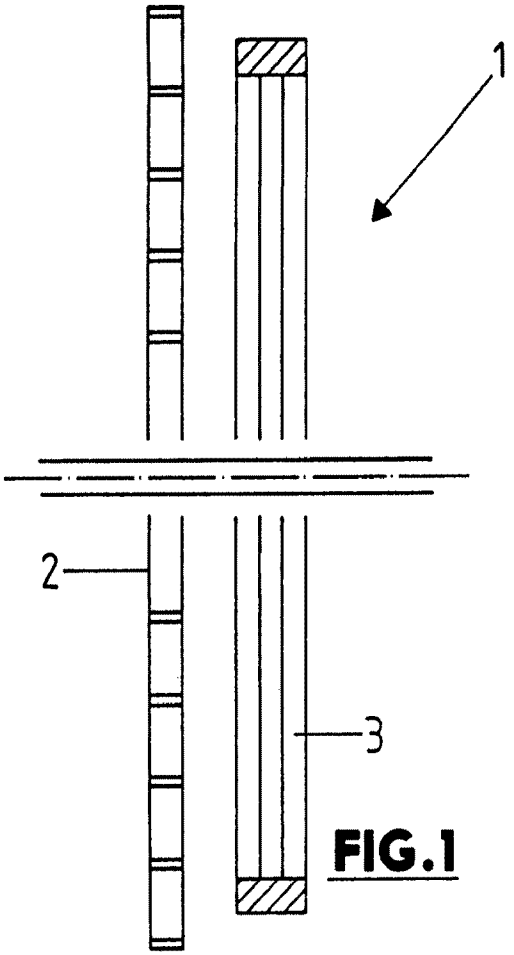
FIG. 1 is a simplified functional depiction showing the essential elements of a mechanical oscillating system of a wristwatch.

The oscillating system generally designated 1 in the drawing consists of the spiral spring 2 and the oscillating or balance wheel 3. The balance spring 2 is manufactured from silicon, preferably from polycrystalline silicon. The balance spring 2 is manufactured, for example, from a non-metallic crystalline or sintered material with a grain size between 10 and 50,000 nm, preferably between 10-10,000 nm, and the column growth of the grain size has a length, for example, of about 5-50 μm and a width of 10-1000 nm. Further, the non-metallic crystalline or sintered material has a linear thermal expansion coefficient smaller than $8\times10^{-6}$/K or the balance spring 2 is manufactured using a wafer from this material or from silicon, e.g., by cutting and/or etching (masking and etching technology). The wafer is produced, for example, by epitaxial deposition. The cross-sectional area of the spring winding is, for example, 0.001-0.01 $mm^2$.

The balance spring 2 is provided on the outer surface of its windings with a layer of silicon oxide which is produced thermally, for example. This layer has a maximum thickness of 4 μm, preferably a maximum thickness of 3 μm or less.

The oscillating mass or the oscillating body, i.e., the oscillating or balance wheel 3, which, for example, has the shape of a spoked wheel typical of such balance wheels, is manufactured from molybdenum or an alloy with a high molybdenum content. In an example embodiment, the oscillating body is manufactured from a copper—beryllium alloy for temperature compensation. Due to the combination of silicon (for the balance spring 2) and molybdenum (for the balance wheel 3), an optimally temperature compensated mechanical oscillating system is obtained, i.e., its accuracy or frequency precision is independent especially of temperature changes, among other factors.

FIG. 2 shows the spiral spring 2 again in a component drawing. A special feature of this spiral spring is that it is designed to be multiply wave-shaped in the area of its outer spring end at 2.1. This area results in an improved, very even oscillating behavior of the spiral spring 2.

The spiral spring 2 with the section 2.1 is advantageously also usable for oscillating systems for clocks, especially wristwatches, in which the oscillating mass is designed otherwise than as described above.

Figure 3:
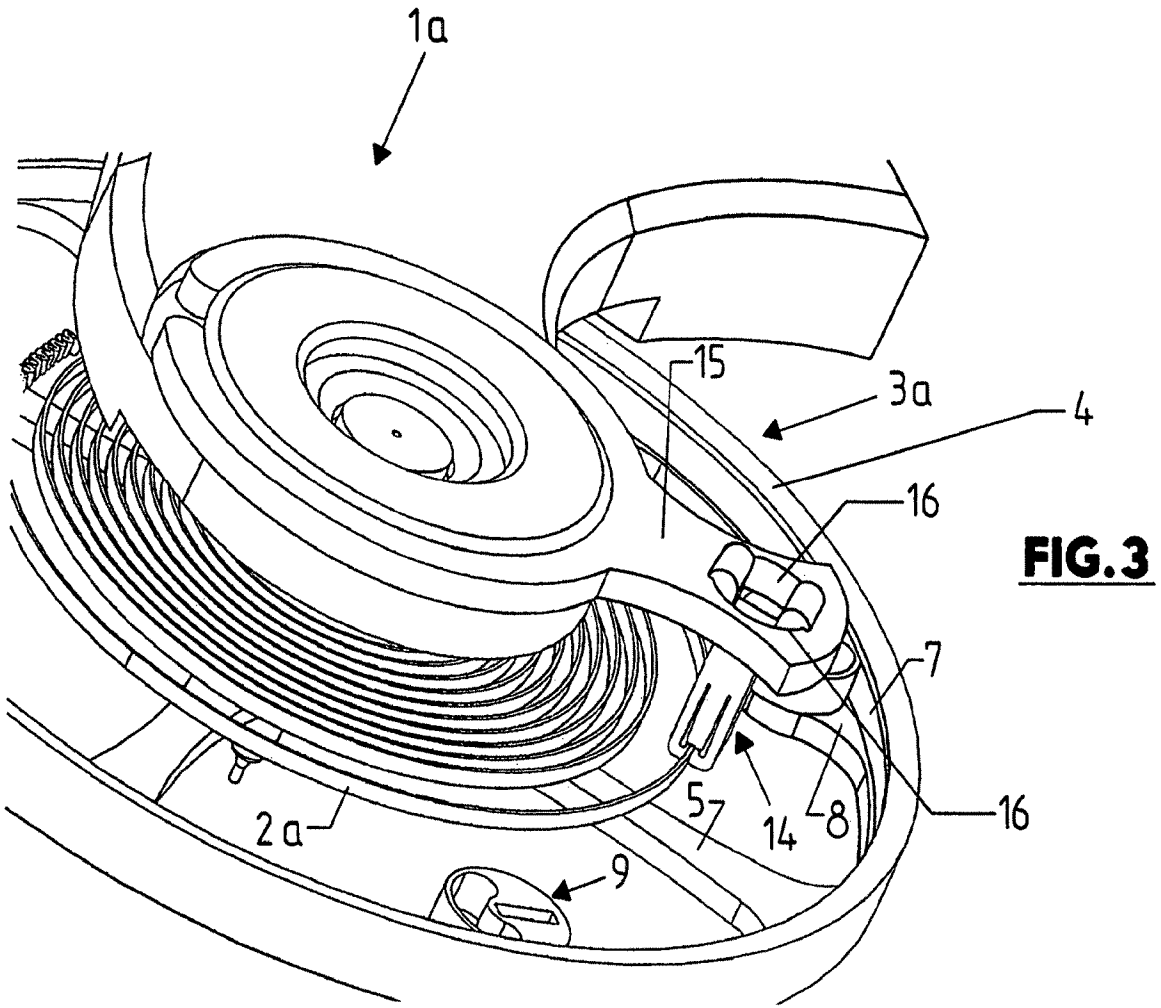
FIG. 3 is a perspective partial view showing a mechanical oscillating system for clocks, especially wristwatches, according to a further embodiment.
Figure 4:
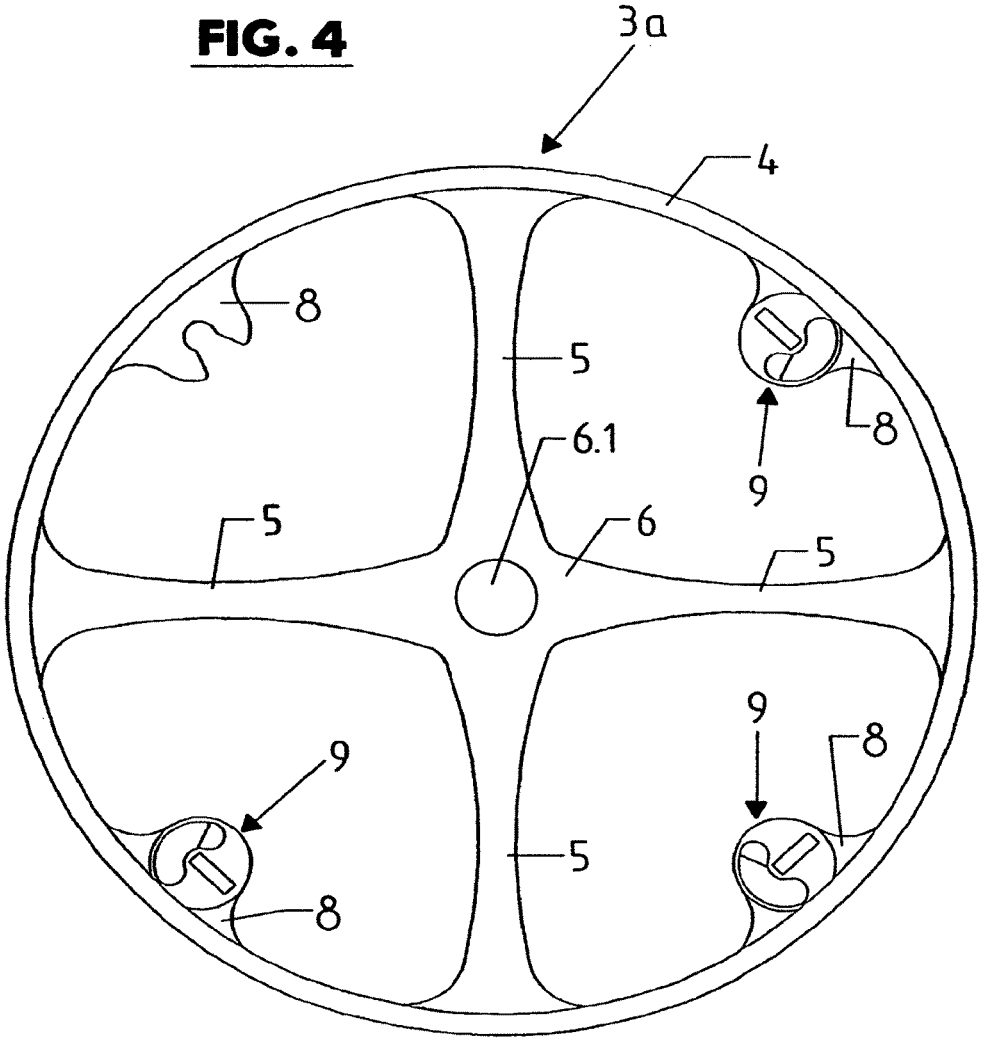
FIG. 4 is a component drawing in top view showing the oscillating and balance wheel of the oscillating system of FIG. 3.
Figure 5:
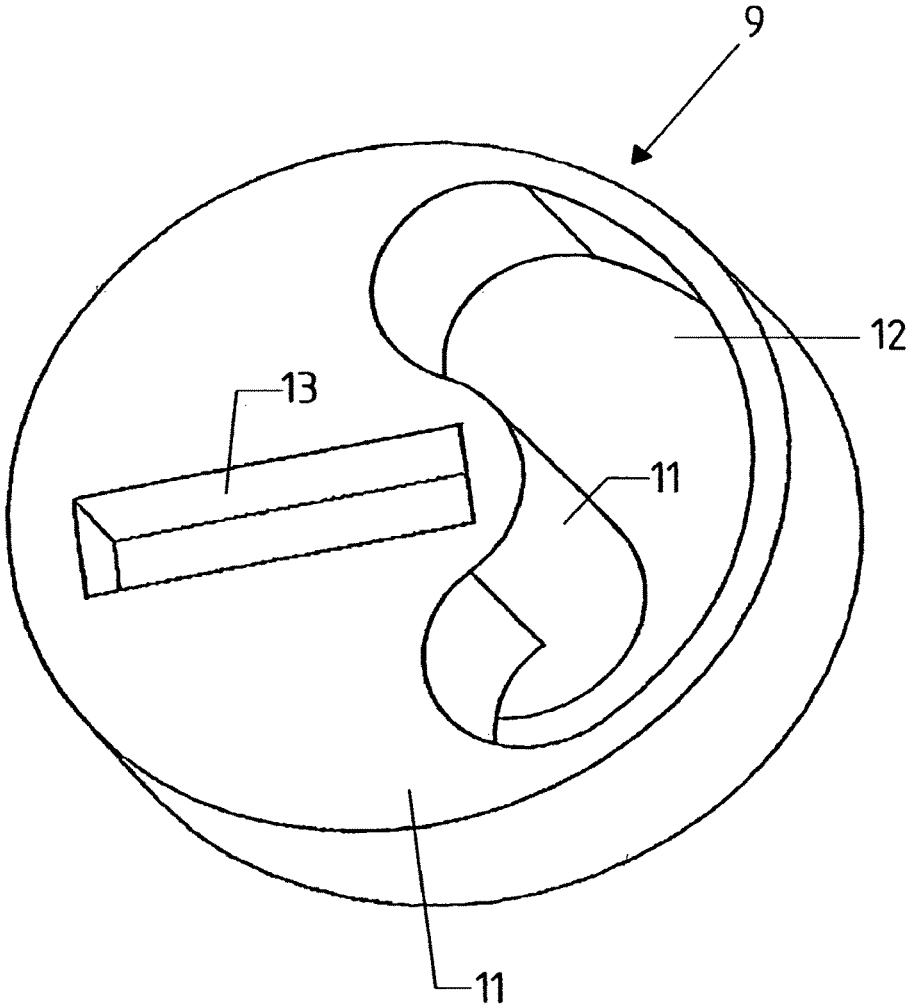
FIG. 5 is a perspective view and top view of a centering element of the balance wheel of the oscillating system of FIG. 3.

FIG. 3 shows a perspective view of an oscillating system 1*a* with the spiral spring 2*a* and the oscillating or balance wheel 3*a*. The balance spring 2*a* and the balance wheel 3*a* are manufactured from the same material and/or in the same manner as described above for the spiral spring 2 and the balance wheel 3.

The balance wheel 3*a* is designed in the shape of a spoked wheel, comprising an outer ring 4, four spokes 5 extending radially inward from the ring 4 and a middle hub section 6, which includes an opening 6.1 for mounting on the balance staff and is manufactured as one piece with the spokes 5 and the outer ring 4.

The outer ring 4 is provided on its inner side with a circumferential groove 7 and with a fork-like mounting section 8 respectively between the spokes 5. On each mounting section 8 there is an adjusting element 9, which is manufactured as one piece from a non-magnetic metal material, e.g., of molybdenum or of a non-corrosive steel. The adjusting elements 9, which like the spokes 5 are arranged at equal angle distances around the axis of the balance wheel 3*a* or the opening 6.1, can be used to adjust the dynamic moment of inertia of the balance wheel 3*a* to define the frequency or oscillation period of the oscillating system. The mounting sections 8 are provided respectively under the groove 7.

For this purpose, the adjusting elements 9 consist of a circular body 10 with a journal 11 which has a cylindrical outer surface and is positioned axially congruent with the axis of said body and extends over one front end of the centering element 9. Further, a curved recess 12 is provided in the body 10, which (recess) is open and curved in an arc-shape on both faces of the disk-shaped body 10 and which extends somewhat less than 180° around the axis of the centering element 9, namely, such that the centering element 9 or its body 10 comprises a continuous edge on its outside circumference, but the center of mass of the centering element 9 is radially offset to the axis of the centering element 9. On the top side facing away from the journal 11, the body 10 is further provided with a slot-shaped recess 13 extending radially or approximately radially to the axis of the centering element and forming the contact or actuating surface for an adjusting tool, for example, for a screwdriver. Each centering element is supported by the journal 11 on one mounting section 8 rotatably around an axis parallel to the axis of the balance wheel 3*a*, with a certain resistance to rotation due to the fact that the respective journal 11 is held on the fork-shaped mounting section 8 by snapping or locking into place and the outer periphery of the disk shaped body 10 of each adjusting element 9 extends into the groove 7, is axially secured therein and bears radially against the bottom of the groove.

Mounting of the adjusting elements 9 on the ring 4 therefore takes place in the manner that the journal 11 of each adjusting element 9 is pushed radially onto the corresponding fork-shaped mounting section 8. By turning or swiveling the adjusting elements 9 around the axis of the journals 11, the center of mass of each adjusting element can be displaced, e.g., radially to the axis of the balance wheel 3*a* so that the dynamic mass moment of inertia can be adjusted in the desired manner. After adjusting the adjusting elements 9, they are secured by means of a suitable adhesive or sealing coat.

The balance spring 2*a* is fastened at its inner end to the balance staff, which is not depicted, in the drawings. The outer end of the spiral spring 2*a* is held on a spring retainer block 14 of a spring retainer 15 which is adjustable around the axis of the balance wheel 3*a*.

Figure 6:
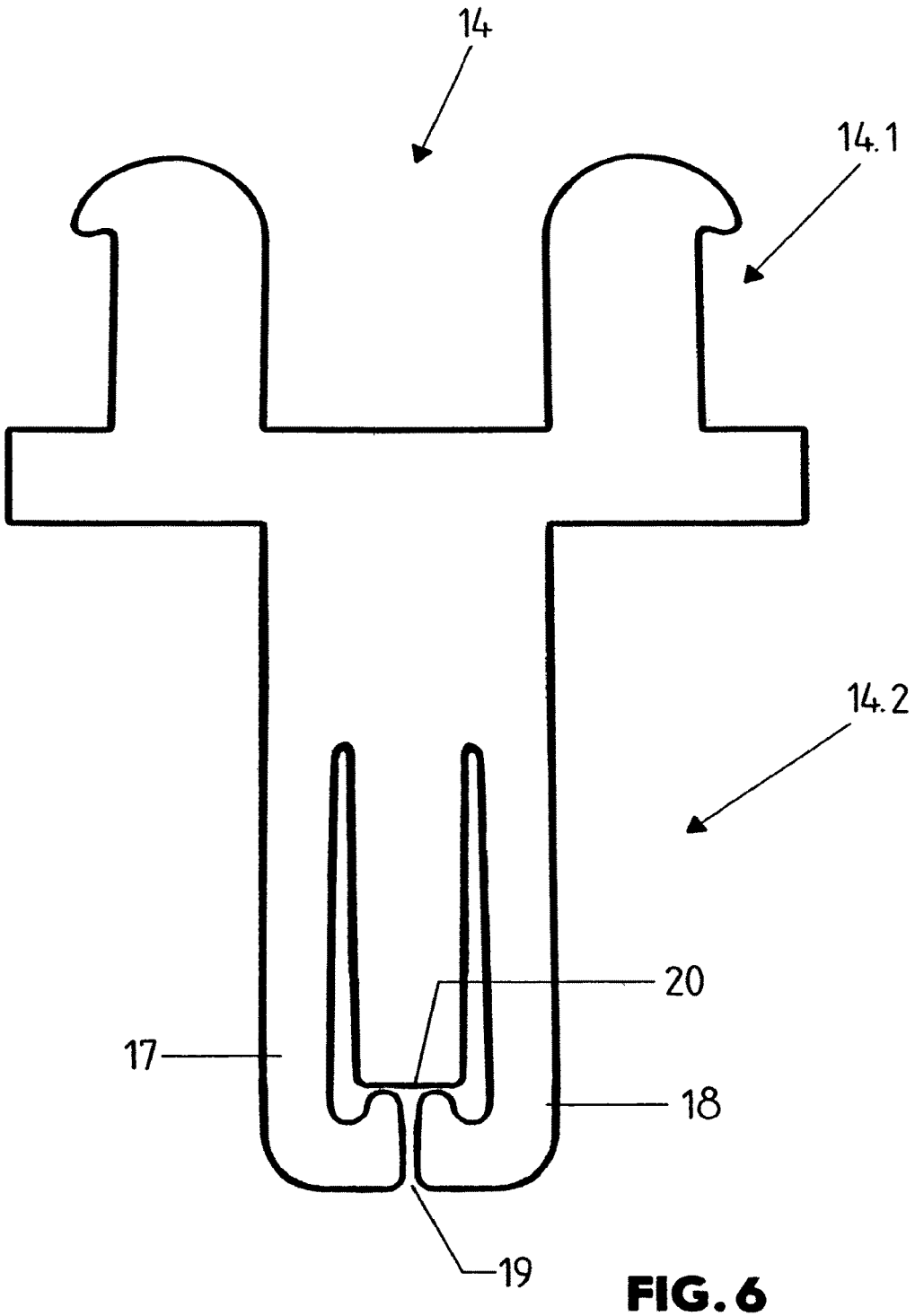
FIG. 6 is a component drawing showing a spring retainer or retainer block for the spiral or balance spring of the oscillating system of FIG. 3; and, FIG. 7 is a simplified depiction showing a cross section through a multi-layer coating of a function element manufactured from silicon.

As can be seen especially in FIG. 6, the spring retainer block 14, which is manufactured from a metal material, is designed with a section 14.1 with which it can be fastened in an opening 16 of the spring retainer 15 by clipping or locking, and with a section 14.2 with two fork or clamping arms 17 and 18, which in between form a clamping gap 19 in which the spiral spring 2*a* can be fastened by clamping. The clamping gap 19 is open toward the bottom side facing away from the section 14.1 and also toward two opposing faces of the spring retainer block 14 and is limited by a surface 20.1 on the side facing the section 14.1.

In an assembled state, the spring retainer block 14 is oriented with its longitudinal extension parallel to the axis of the balance wheel 3*a*. During assembly of the oscillating system the outer section of the spiral spring 2*a* is inserted into the clamping gap 19 from the bottom side of the spring retainer block 14 facing away from the section 14.1 or the spring retainer 15. Therefore, the spiral spring 2*a* is already held on the spring retainer block 14 mounted on the spring retainer 15 so that an alteration and adjustment of the effective spring length required for adjusting the frequency of the mechanical oscillating system is possible by moving the spiral spring 2*a* relative to the spring retainer block 14 while maintaining the clamping connection. After this adjustment, the connection between the spiral spring 2*a* and the spring retainer block 14 is secured using a suitable adhesive or sealing coat.

The adjusting elements 9, and, in particular, the respective spring retainer block 14, are preferably manufactured as so-called LIGA parts using the LIGA process known to persons skilled in the art, and through which the process steps of lithography, electroplating and molding enables the manufacture of metal pre-formed bodies with very small dimensions.

Figure 7:
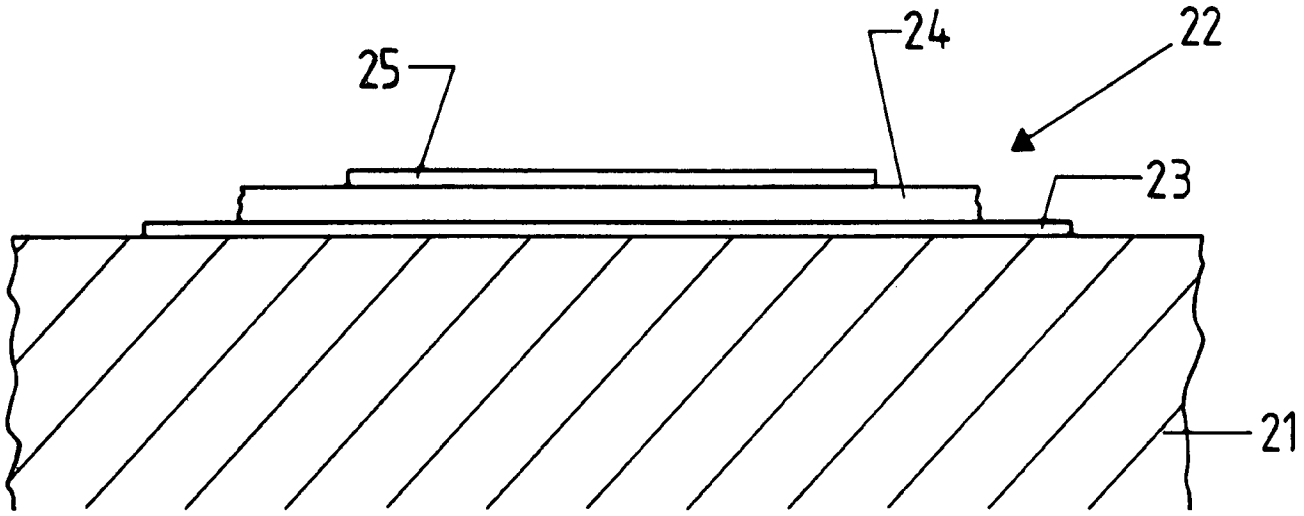

FIG. 7 schematically shows the embodiment of a bearing and/or sliding and/or mounting surface of a functional element 21, which is made of silicon, preferably of polycrystalline silicon, for example, epitaxially deposited polycrystalline silicon. The surface 22 forming the bearing and/or sliding and/or mounting surface of the functional element 21 is formed by a multi-layer coating, at least comprising a coating 23 of silicon oxide which adjoins directly to the silicon material of the functional element 21 and is produced, for example, by thermal oxidation or another suitable manner. The coating 23 is followed by a metal intermediate layer 24 which preferably consists of titanium-nitride and/or titanium carbide and/or tungsten carbide and is applied, for example, in a physical vapor deposition (PVD) coating process. The intermediate layer 24 can in turn be multi-layered, namely, with several single layers, e.g., of the above-named materials. The intermediate layer 24 is followed by the coating 25 forming the actual outer surface which is embodied as a DLC or diamond like carbon coating and is produced, for example, through chemical vapor deposition (CVD). The invention is based on the finding that the metal intermediate layer 24 achieves improved adhesion of the layer 25 to the layer 23, so that chipping or flaking of the layer 25 from the functional element 21 is effectively prevented during assembly and during use of a clock. This applies not only to bearing and sliding surfaces, but also in particular to mounting surfaces and especially also to such surfaces with which or on which fastening by clamping is used, for example, fastening by clamping of the spiral or balance spring or of the oscillating body to a shaft, etc.

The invention is described above based on exemplary embodiments. It goes without saying that numerous modifications and variations are possible without abandoning the underlying inventive idea upon which the invention is based.

Instead of the above-mentioned silicon material (e.g., polycrystalline silicon), particularly suitable is also a silicon-based sintered material or silicon-sintered material and/or a non-metal crystalline or sintered material with a grain size between 10 and 50,000 nm and a linear thermal expansion coefficient smaller than $8\times10^{-6}$/K.

REFERENCE NUMBERS

1, 1*a* Mechanical oscillating system
2, 2*a* Balance spring
3, 3*a* Balance wheel
4 Band or ring
5 Spoke
6 Hub-shaped section
7 Groove
8 Fastening section
9 Adjusting element
10 Disk-shaped body of adjusting element 9
11 Journal of adjusting element 9
12 Recess
13 Slot
14 Spring retainer block
14.1, 14.2 Section of spring retainer block
15 Spring retainer
16 Opening
17, 18 Clamping arm
19 Clamping gap
20 Contact surface
21 Function element
22 Surface of function element 21
23, 24, 25 Coating or layer

What is claimed is:

1. A mechanical oscillating system for a clock, comprising:

a balance spring, wherein the balance spring is manufactured from a polycrystalline silicon having a grain size between 10 and 50,000 nm, a winding area of the balance spring from 0.001 $mm^2$ to 0.3 $mm^2$, and a surface of the balance spring is provided with a layer of silicon oxide so that the balance spring has a linear expansion coefficient smaller than $8\times10^{-6}$/K;

an oscillating body; and, a shaft for mounting of the oscillating body and the balance spring on the shaft;

wherein the polycrystalline silicon comprises elongated grains having a grain width between 10 and 1000 nm and a grain length between 5 and 50 μm.

2. The mechanical oscillating system recited in claim 1, wherein the grain size is between 10 and 10,000 nm.

3. The mechanical oscillating system recited in claim 1, wherein the winding area of the balance spring is 0.001 $mm^2$ to 0.03 $mm^2$.

4. The mechanical oscillating system recited in claim 1, wherein the winding area of the balance spring is 0.001 $mm^2$ to 0.01 $mm^2$.

5. The mechanical oscillating system recited in claim 1, wherein the grain length is between 5 and 50 μm.

6. The mechanical oscillating system recited in claim 1, wherein the oscillating body, for temperature compensation, is manufactured from a copper-beryllium alloy.

7. The mechanical oscillating system recited in claim 1, wherein the oscillating body is a wheel- or disk-shaped oscillating body.

8. The mechanical oscillating system recited in claim 1, further comprising a spring retainer block with a clamping gap for holding by clamping of the spiral or balance spring in the area of an outer spring end of the balance spring.

9. A spiral spring for a clock being manufactured from a non-metallic material, wherein the non-metallic material is a polycrystalline silicon having a grain size between 10 and 50,000 nm, a surface of the balance spring is provided with a layer of silicon oxide and having a linear thermal expansion coefficient smaller than $8\times10^{-6}$/K, wherein the polycrystalline silicon comprises elongated grains having a grain width between 10 and 1000 nm and a grain length between 2 and 50 μm.

10. The spiral spring recited in claim 9, wherein the polycrystalline material has a grain size between 10 and 10,000 nm.

11. The spiral spring recited in claim 9 including a winding area is from 0.001 $mm^2$ to 0.3 $mm^2$.

12. The spiral spring recited in claim 9, wherein a winding area is from 0.001 $mm^2$ to 0.03 $mm^2$.

13. The spiral spring recited in claim 9, wherein a winding area is from 0.001 $mm^2$ to 0.01 $mm^2$.

14. The spiral spring recited in claim 9, wherein the grain length is between 5 and 50 μm.

* * * * *